United States Patent [19]

Boller

[11] Patent Number: 4,642,033

[45] Date of Patent: Feb. 10, 1987

[54] POSITIVE DISPLACEMENT AIR COMPRESSORS

[75] Inventor: Edward Boller, West Midlands, England

[73] Assignee: The Hydrovane Compress or Company Limited, Redditch, England

[21] Appl. No.: 798,917

[22] Filed: Nov. 18, 1985

[30] Foreign Application Priority Data

Nov. 19, 1984 [GB] United Kingdom ..... 8429144

[51] Int. Cl.[4] ..... F04B 49/02; F04B 49/08; F04B 49/10

[52] U.S. Cl. ..... 417/295; 417/302

[58] Field of Search ..... 417/295, 302, 304

[56] References Cited

U.S. PATENT DOCUMENTS

| | | | |
|---|---|---|---|
| 2,951,633 | 9/1960 | Fites | 417/295 X |
| 3,072,146 | 1/1963 | Gizeski | 137/599 X |
| 4,207,919 | 6/1980 | Hutton | 137/599 X |
| 4,244,396 | 1/1981 | Friedland et al. | 137/599 X |
| 4,553,906 | 11/1985 | Boller et al. | 417/295 |

FOREIGN PATENT DOCUMENTS 1257728 12/1971 United Kingdom .

*Primary Examiner*—John J. Vrablik

*Attorney, Agent, or Firm*—Cushman, Darby & Cushman

[57] ABSTRACT

A rotary positive displacement air compressor includes a stator containing a rotor and having an inlet and an outlet. The inlet includes two or more inlet apertures in parallel associated with independently actuable pistons. Detecting means detects the pressure of the compressed air and produces a signal when this pressure exceeds or is less than predetermined values and thus indicates whether the rate at which air is being compressed exceeds or is less than the compressed air demand to which the compressor is subjected. The two pistons are associated with respective actuating means which are controlled by the detecting means for opening and closing each inlet aperture independently to vary the rate of air flow through the inlet.

4 Claims, 1 Drawing Figure

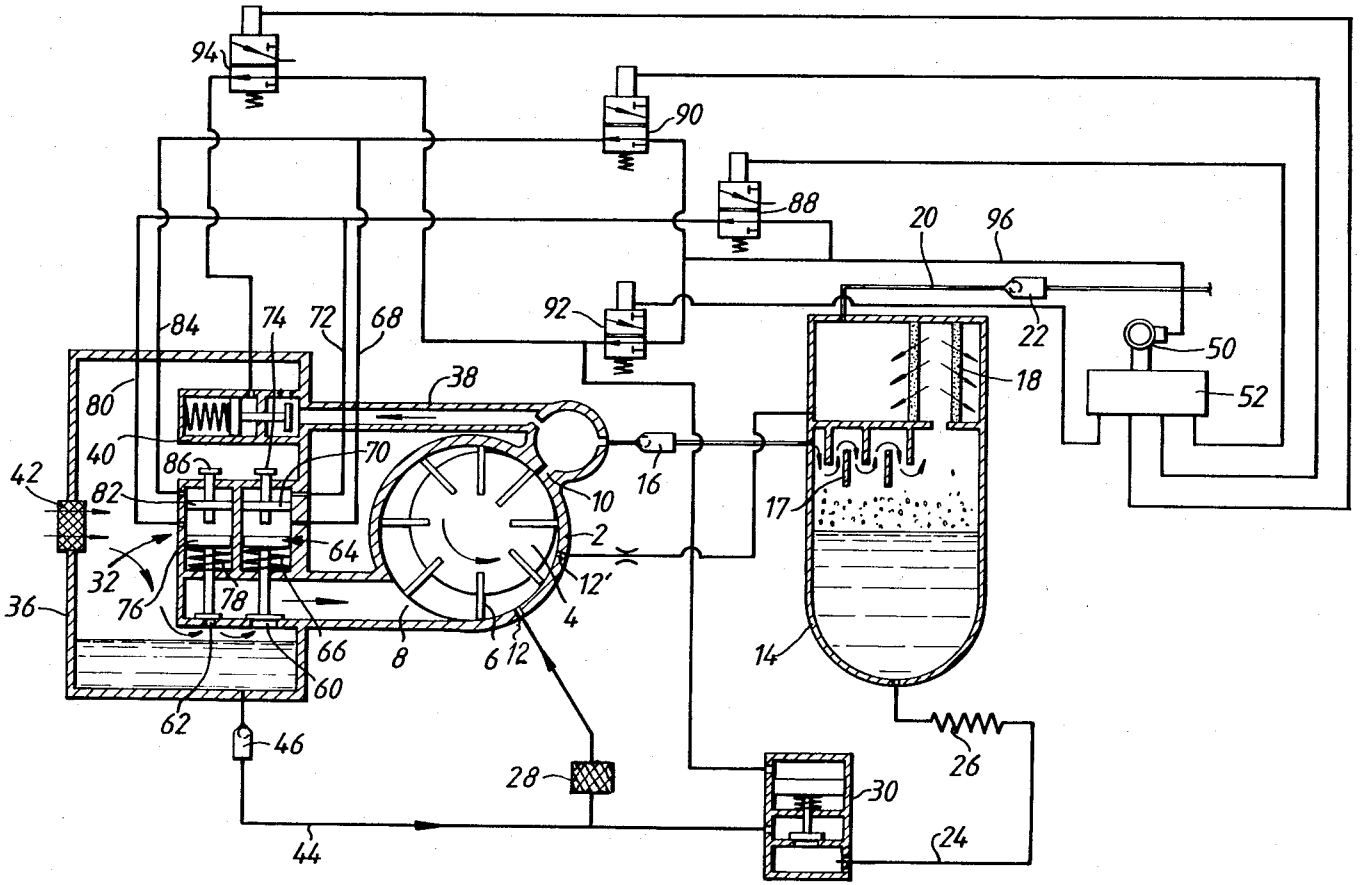
52
50
22
18
96
20
88
90
92
94
26
24
30
17
14
16
10
2
12'
4
12
6
28
38
8
68
70
64
66
60
72
74
78
46
44
84
86
62
80
40
82
32
76
42
36

POSITIVE DISPLACEMENT AIR COMPRESSORS

The present invention relates to positive displacement compressors, in particular of rotary oil-sealed type, and is concerned with matching the output of such compressor with the demand for compressed air. The term "oil-sealed compressor" is used herein to designate that type of compressor in which a lubricant is injected into the compression space and is then subsequently removed from the compressed air and recycled.

When a positive displacement rotary compressor is operating at less than full load conditions, the pressure at its outlet tends to rise to a value above the normal working value and/or the pressure at its inlet tends to fall to a value less than normal. This means that the compression elements must work against a pressure differential higher than normal with the result that such compressors tend to consume more power per volumetric unit of output at, say, three quarters load than they do at full load. When the compressed air requirement is less than the full load requirement the outlet pressure tends in fact to continue rising and for this reason it is known to provide the inlet of such compressors with a pilot operated valve which closes the inlet when the outlet pressure reaches a predetermined value. Such valves may be movable between only two positions, that is to say a fully opened position and a fully closed position, or alternatively the valve may be a so called unloader valve which is progressively controlled by a servo valve in response to a rise of the outlet pressure above the normal working pressure to modulate the inflowing air with the result that as the outlet pressure rises, the inlet is progressively throttled and then finally closed. The provision of such a valve on the compressor inlet results in a power economy at no-load or reduced load conditions but the compressor still consumes a very substantial amount of power since the internal pressure differential across the compression elements is still above the normal value. It is known, e.g. from U.S. Pat. No. 4,388,046 and British Patent No. 1257728 to reduce the pressure within the stator when there is no demand for compressed air thereby reducing the work done by the compression elements against the pressure differential across them. The maximum power economy is of course achieved when the pressure within the stator is reduced to atmospheric and such a compressor described in British Patent No. 1257728. This prior patent discloses a compressor of eccentric rotor sliding vane type whose inlet includes a pilot operated shut-off valve, and which has an outlet communicating with a separate main lubricant reservoir via a non-return valve and with an auxiliary lubricant reservoir. The main lubricant reservoir communicates with an oil injection aperture in the stator by means of a pipe including a pilot operated valve whilst the auxiliary reservoir communicates directly with this aperture. The pipe connecting the compressor outlet to the lubricant reservoirs may be selectively vented to the atmosphere by a further pilot controlled valve. The various pilot controlled valves are under the control of a pilot which is responsive to the pressure in the main lubricant reservoir. In normal operation, air is drawn in through the inlet and compressed by the rotor/stator unit into which lubricant is injected. The entrained oil is subsequently removed from the air which then passes to an outlet line. If the compressed air load is reduced substantially below the full rate load, the pressure in the main reservoir rises and when this exceeds the predetermined pressure the pilot closes the pilot operated valve in the inlet thereby preventing further air from entering the compressor inlet, closes the pilot operated valve in the line connecting the main reservoir to the rotor/stator unit, therby preventing oil from being fed from this reservoir into the compression space, and opens the pilot operated valve communicating with the pipe connecting the stator outlet to the main reservoir thereby connecting the stator outlet to atmosphere. The pressure in the compression space, i.e. within the stator and the auxiliary lubricant reservoir fall substantially to atmospheric pressure whilst the pressure at the inlet tends to drop to a value somewhat below atmospheric pressure. The pressure in the compression space at the oil injection aperture is therefore also slightly subatmospheric and this pressure therefore results in a small volume of oil being drawn from the auxiliary reservoir into the compression space and this volume is sufficient for the needs of the rotor/stator unit. If the compressed air load should resume, or alternatively if the compressed air load had not in any event fallen to zero, the pressure in the main reservoir progressively falls and when this becomes less than a further predetermined value, the pilot reverses the positions of the various pilot operated valves and normal operation is resumed.

This construction is advantageous in that when the compressor is running under no-load conditions, the pressure at the stator outlet is atmospheric and thus the rotor/stator unit absorbs the minimum amount of power, perhaps about 20% of its full rated power. However, if the compressed air demand is a fraction of the full rated output, the compressor will cycle between normal operation and its idling depressurised operation and this is itself wasteful of power since compressed air in the interior of the stator and the auxiliary reservoir is repeatedly vented to atmosphere and thus must be subsequently repressurised. Thus, in the prior construction the inlet valve is either fully closed or fully open and there is no attempt to match the volume of air flowing into the stator with the demand for compressed air. Such matching could theoretically be effected by replacing the inlet valve with a conventional unloader valve, as described above, but such unloader valves are relatively complex and expensive and in addition it is found to be difficult to make an unloader valve operate effectively also as a shut-off valve and it is essential in the compressor of British Patent No. 1257728 that the inlet can be completely closed as soon as the outlet pressure has reached the predetermined value.

Accordingly it is an object of the present invention to provide a positive displacement compressor which has all the advantages of the construction of British Patent No. 1257728 but which avoids its disadvantages and which in particular is provided with an inlet valve which is not of unloader type but which nevertheless enables the volume of air entering the compressor to be matched at least approximately to the demand for compressed air.

According to one aspect of the present invention a positive displacement air compressor has an inlet which includes two or more independently actuable inlet valves in parallel, detecting means for determining whether the rate which air is being compressed exceeds or is less than the compressed air demand to which the compressor is subjected and actuating means controlled by the detecting means for opening and closing each inlet valve independently to vary the rate of air flow through the inlet.

According to a further aspect of the present invention a rotary positive displacement air compressor includes a stator containing a rotor and having an inlet and an outlet, the inlet having two or more independently actuable inlet valves in parallel, detecting means for detecting the pressure of the compressed air and arranged to produce a signal when the said pressure exceeds or is less than predetermined values thereby indicating whether the rate at which air is being compressed exceeds or is less than the compressed air demand to which the compressor is subjected and actuating means controlled by the detecting means for opening and closing each inlet valve independently to vary the rate of air flow through the inlet.

Thus in the compressor in accordance with the present invention there are two or more inlet valves arranged in parallel and thus by opening and closing these in different combinations the rate of airflow into the compressor can be varied without the necessity of providing a valve of conventional unloader valve type, that is to say a valve which may be progressively moved between its open and closed positions so that the rate at which air is compressed may be matched very coarsely to the compressed air demand and whilst the matching is unlikely to be precise any difference could be compensated for, at least in the short term, by providing the compressor with a receiver, that is to say a reservoir for excess compressed air.

It is preferred that each inlet valve is associated with an inlet aperture and that the sizes of the inlet apertures differ. Thus if two identical inlet apertures are provided only two different air flow rates into the compressor can be achieved but if the inlet apertures are of a different size three different air flow rates can be achieved. It is preferred that each inlet valve is operated by a fluid that is pressurised by the compressor and in the case of an oil sealed compressor this fluid may constitute oil. It is, however, preferred that the fluid is compressed air.

The detection as to whether the rate at which air is compressed differs from the demand for compressed air may be effected in various ways but it is preferred that it is effected by measuring the pressure of the compressed air produced since this will rise when the rate of supply exceeds the demand and will fall when demand exceeds supply and thus constitutes a simple means by which the difference between the rates of supply and demand may be detected. In the preferred embodiment the detecting means is connected to the control means which in turn is connected to a respective control valve for each inlet valve, the control means being arranged to increase or decrease the open area of the compressor inlet by one increment when the said pressure exceeds or is less than the said values, respectively. Thus when the supply of compressed air exceeds the demand the control means will close one of the inlet valves or alternatively close one of the inlet valves and open an inlet valve with a smaller inlet area.

In one embodiment each valve includes a main pistonwhose movement is controlled by the associated control valve and an auxiliary piston which is movable under the control of the control means into a position which limits the movement of the associated main piston, the control means being so arranged that when one inlet valve is closed the auxiliary piston of the other inlet valve or valves is positioned to limit the movement of the associated main piston but when all these valves are open the auxiliary pistons are positioned not to limit the movement of the main pistons. Thus in this embodiment the main piston of each inlet valve has three positions, that is to say fully open, fully closed and partially open and this is found to be desirable in order to be able accurately to control the rate of air flow through each inlet valve since this will vary in dependence on how many other inlet valves are open.

As mentioned above, when the detecting means indicate that the rate of supply of compressed air exceeds the demand the control means is arranged to decrease the open area of the compressor inlet by one increment but if the demand for compressed air is zero the pressure of the compressed air will rise above the predetermined value and remain there. In this condition the compressor will still consume a substantial amount of energy. It is therefore preferred that the compressor also includes venting means arranged to vent the interior of the stator down to a pressure substantially less than normal working pressure when the demand for compressed air is substantially zero which reduces the amount of energy consumed by the compressor when running on no load. In the most preferred form of the invention the stator inlet communicates with atmosphere via a first pilot operated valve, the stator outlet is connected to a primary lubricant reservoir via a non-return valve and to an auxiliary lubricant reservoir which is always substantially at atmospheric pressure via a second pilot operated valve and the compressor includes a lubricant injection orifice connected to the primary reservoir via a third pilot operated valve and to the second reservoir and a pilot control system responsive, in use, to the compressed air load to which the compressor is subjected and arranged to switch the first and third pilot operated valves from an open position to a closed position, and the second pilot operated valve from a closed position to an open position when the compressed air load falls below a predetermined value, e.g. the compressed air load is substantially zero. Thus in this preferred embodiment the compressor includes means which vent the stator down to substantially atmospheric pressure when there is no demand for compressed air, which venting means are generally similar to those disclosed in British Patent No. 1257728 and which are disclosed in more detail in U.S. patent application Ser. No. 654,678, now U.S. Pat. No. 4,553,906, of the present applicant, the disclosure of which is incorporated herein by reference.

Further features and details of the present invention will be apparent from the following description of one specific embodiment which is given by way of example only, with reference to the accompanying drawing which is a diagrammatic representation of a rotary compressor in accordance with the present invention.

compressor is of eccentric rotor sliding vane type and includes a stator 2 within which a rotor 4 is eccentrically rotatably mounted. The stator and rotor together define a crescent shaped working space which is divided into working cells by a number, in this case eight, of vanes 6 which are slidably accommodated in a respective longitudinal slot in the rotor. The construction and operation of this rotor/stator unit are conventional and will therefore not be described in more detail. The stator has an inlet 8, an outlet 10 and one or more oil injection orifices 12, 12 situated between the inlet and the outlet with respect to the intended direction of rotation of the rotor. The stator outlet 10 communicates with a primary oil reservoir 14 via a non-return valve 16, the reservoir 14 accommodating a plurality of baffle plates 17 against which the compressed air impinges and a conventional coalescing element 18 and communicating with a supply line 20 via a further non-return valve 22. The lower end of the primary reservoir 14 communicates with the oil injection orifice 12 via a line 24 which includes an oil cooler 26 and an oil filter 28, which are conventional and will therefore not be described, and a pilot operated shut-off valve 30. The stator inlet 8 is controlled by a pilot operated inlet valve assembly 32 which is accommodated within an inlet housing 36 and will be described in more detail below. Ths stator outlet 10 also communicates with the inlet housing 36 by means of a line 38 which is controlled by a further pilot shut-off valve 40. When valve 40 is open, line 38 communicates with the inlet housing 36 through the opening shown in the housing of valve 40. The inlet housing 36 communicates with the atmosphere via a conventional air filter 42, and constitutes a secondary or auxiliary oil reservoir the base of which communicates with the oil injection orifice 12 via a line 44 which includes a non-return valve 46 and the oil filter 28 which is common to the lines 24 and 44.

The compressor also includes a pilot control system comprising a pressure sensitive switch assembly 50 which communicates with the supply line 20 downstream of the valve 22 and is thus responsive to the pressure within the primary reservoir in normal operation. The switch assembly is also connected to a microprocessor based control unit 52 which controls the position of four solenoid valves, as will be discussed below. The inlet valve assembly 32 comprises a first valve which controls an inlet aperture 60 and a second valve which controls an inlet aperture 62 whose area is half that of the aperture 60. The first valve comprises a main piston 64 which cooperates with the aperture 60 and acts against a spring 66 and is actuated by a compressed air line 68 and an auxiliary piston 70 which is actuated by a compressed air line 72 and whose movement is limited by a stop 74. The second valve similarly comprises a main piston 76 which cooperates with the aperture 62 and acts against a spring 78 and is actuated by a compressed air line 80 and an auxiliary piston 82 which is actuated by a compressed air line 84 and whose movement is limited by a stop 86.

The compressed air lines 72 and 80 communicate and are controlled by a solenoid valve 88 and the lines 68 and 84 also communicate and are controlled by a solenoid valve 90. Further solenoid valves 92 and 94 are provided to control the pilot operated valves 30 and 40 respectively. All four solenoid valves are supplied with compressed air via a compressed air line 96 which communicates with the compressor outlet line 20 downstream of the valve 22 and are controlled by the control unit 52. It will be noted that the air supply to the solenoid valve 94 comes from the solenoid valve 92. This ensures that the pilot operated valve 30 is always closed when the pilot operated valve 40 is open. Thus if valve 92 fails, valve 94 will also fail to deliver an output.

The pressure switch assembly 50 includes two sets of contacts, referred to as the high pressure contacts and low pressure contacts, which open and close when the pressure in the line 22 exceeds the normal supply pressure or is less than the normal supply pressure by more than 2%, e.g. 5%, respectively. Each time the high pressure contacts close or the low pressure contacts open, thereby indicating that the rate of compression of air exceeds or is less than the demand for compressed air respectively, the control unit 52 delivers a switching signal to one or more of the solenoid valves.

In normal operation, that is to say when the demand for compressed air is equal to the rated output of the compressor, the solenoid valve 92 is closed and the solenoid valve 94 is closed so that the pilot operated valves 30 and 40 are open and closed respectively. Solenoid valves 88 and 90 are both closed so that both the main and auxiliary pistons 64,76,70 and 82 of the inlet valve assembly are in their uppermost positions and the inlet apertures 60 and 62 are fully open. The rotor rotates within the stator and draws air in through the air filter 42 which passes around the open inlet valves and is compressed in the crescent shaped working space within the stator. Oil within the primary reservoir 14, which is at the supply pressure of the compressor, flows along the line 24 and through the open valve 30 into the working space via the injection orifice 12, and passes with the compressed air through the stator outlet 10. The compressed air and oil mixture all passes through the non-return valve 16 into the primary reservoir 14 since the valve 40 is closed, and the majority of the oil is instantly deposited in the primary reservoir 14 whilst the remainder is coalesced by the element 18.

If the demand for compressed air should fall the pressure in the supply line 22 will begin to rise and when it has risen from say, 7 bar to, say, 7.1 bar the high pressure contacts of the switch 50 will close. The control unit 52 then opens solenoid valve 88 thereby moving the main piston 76 downwardly and closing the inlet aperture 62 and moving auxiliary piston 70 downwardly until the stop 74 engages the housing of the inlet valve assembly. The air flow rate into the compressor is thus reduced to two thirds of its original value.

If the compressed air load should in fact be, say, 90% of the rated load the pressure in the line 22 will gradually drop and the high pressure contacts and then the low pressure contacts of the switch 50 will open. When the latter happens the solenoid valve 88 is closed again and the compressor cycles between these two modes of operation. If the compressed air load is less than two thirds of the rated load the high pressure contacts of the switch 52 remain closed and after the predetermined time, of say, 1 minute the control unit 52 issues another switching signal and the solenoid valves 88 and 90 are closed and opened respectively. The main pistons 64 and 76 are thus closed and opened respectively and the auxiliary pistons 70 and 82 moved up and down respectively. The air flow rate thus drops to one third of its original value.

If the compressed air load is between one third and two thirds of the rated load the compressor will cycle between the states in which only the inlet aperture 60 or the inlet aperture 62 is open. However, if the compressed air load is less than one third of the rated load the control unit issues a further switching signal after the predetermined time and opens both the solenoid valves 88 and 90. The main pistons 64 and 76 are thus moved downwardly closing both the inlet apertures and the auxiliary pistons 70 and 82 are moved upwardly. If the compressed air load is significant but nevertheless less than one third of rated load the compressor will cycle between the two states in which the smaller inlet aperture 62 is open or closed. If the compressed air load is very low or zero the high pressure contacts of the switch 52 will remain closed and the control unit 52 issues a further switching signal and the solenoid valves 92 and 94 are opened thereby closing and opening the pilot operated valves 30 and 40 respectively. Closure of the valve 30 prevents further oil from being withdrawn from the primary reservoir 14 and closure of the valve 32 prevents further air from being drawn into the stator and compressed. The opening of the valve 40 vents the interior of the stator to the atmosphere and the pressure at the stator outlet therefore drops to atmospheric within a very short space of time. The interior of the stator is isolated from the remainder of the compressor by the closure of the valve assembly 32 which seals its inlet, the valve 30 which seals the oil communication with the primary reservoir and the non-return valve 16 which ensures that the primary reservoir is not vented down to atmospheric pressure as well. The residual air and oil within the stator passes through the line 38 and the valve 40 into the inlet housing 36 which constitutes the secondary reservoir and the entrained oil droplets are there deposited. By virtue of the slightly sub-atmospheric pressure at the oil injection orifice 12 when the compressor is operating under no load, a small amount of oil is constantly withdrawn from the housing 36 and injected through the orifice 12 which then passes along the line 38 and through the valve 40, and is thus constantly recycled.

When the compressed air load subsequently reappears, the pressure in the supply line 20 and primary reservoir 14 will rapidly drop and when the low pressure contacts of the switch 52 open the inlet aperture 62 is opened. Depending on the magnitude of the compressed air load, the sequence of the opening and closing of the inlet apertures 60 and 62 described above is wholly or partially reversed.

Thus in the compressor of the present invention the area of the inlet is varied incrementally rather than progressively, as is the case with an unloader valve. The rate at which air is compressed can thus be matched crudely to the compressed air demand. In the compressor described above the rate of air flow into the compressor may be 100%, 66.7%, 33.3% or 0% of the full rate flow and it will be appreciated that these percentages may be varied by altering the sizes of the inlet apertures and that the number of steps may be increased by increasing the number of inlet apertures and associated valves. At any particular compressed air demand the pressure switch 50 will indicate whether the latter is greater than or less than the rate at which air is being compressed and increase or decrease the inlet area in order nearly to match supply and demand. When demand is substantially zero the stator is isolated from the supply line and the primary oil reservoir and is vented down to atmospheric pressure so as to minimise the consumption of energy.

It will be appreciated that each valve of the inlet valve assembly may be of simple form with a single piston and that the dual piston construction which is illustrated serves only to limit the amount by which each valve may open when the other is closed. This is found to bring the flow rates through the inlet apertures into closer correspondence with the ratio of their areas.

It will be appreciated also that the provision of two or more independently controllable inlet valves in parallel may be of value in a variety of different compressors and is not applicable solely to compressor of the type having means for venting down the interior of the stator when the compressed air load drops to zero. Obviously, numerous modifications and variations of the present invention are possible and in the light of the above teachings. It is therefore to be understood that within the scope of the appended claims, the invention may be practiced otherwise than as specifically described herein.

What is claimed as new and desired to be secured by Letters Patent of the United States is:

1. A rotary positive displacement air compressor including:

a stator;

said stator containing a rotor and having an inlet and an outlet, said inlet including at least two independently actuable inlet valves in parallel each operated by a fluid pressurized by said compressor;

detecting means for detecting, in use, the pressure of the compressed air and arranged to produce a signal when said pressure exceeds or is less than predetermined values thereby indicating whether the rate at which air is being compressed exceeds or is less than the compressed air demand to which the compressor is subjected;

actuating means controlled by said detecting means and arranged to open and close each said inlet valve independently to vary the rate of air flow through said inlet;

control means connected to said detecting means;

a respective control valve connected to each said inlet valve and to said control means, said control means being arranged to increase or decrease the open area of said inlet by one step when said pressure exceeds or is less than said predetermined values, respectively, each said inlet valve including a main piston whose movement is controlled by the associated said control valve and an auxiliary piston which is movable under the control of said control means into a position in which it limits the movement of the associated said main piston, said control means being so arranged that when one said inlet valve is closed and at least one other inlet valve is opened the said auxiliary piston of the at least one other inlet valve is positioned to limit the movement of the associated said main piston but when all said inlet valves are open said auxiliary pistons are positioned not to limit the movement of said main pistons.

2. A compressor as claimed in claim 1 wherein each said inlet valve is associated with an inlet aperture and the size of said inlet apertures is different.

3. A compressor as claimed in claim 1 including venting means arranged to vent the interior of the stator down to a pressure substantially less than the normal working pressure when the demand for compressed air is substantially zero.

4. A compressor as claimed in claim 3 including first and second pilot operated valve means, primary and auxiliary lubricant reservoirs and a non-return valve wherein said stator outlet is connected to said primary lubricant reservoir via said non-return valve and to said auxiliary lubricant reservoir, which is always at substantially atmospheric pressure, via said first pilot operated valve means, and said compressor includes at least one lubricant injection orifice connected to said primary lubricant reservoir via said second pilot operated valve means and to said secondary lubricant reservoir, and a pilot control system responsive, in use, to the compressed air load to which said compressor is subjected and arranged to switch said second pilot operated valve from an open position to a closed position, and said first pilot operated valve from a closed position to an open position when said compressed air load falls below a predetermined value.

* * * * *